US006522224B2

(12) United States Patent
Okada et al.

(10) Patent No.: US 6,522,224 B2
(45) Date of Patent: Feb. 18, 2003

(54) METHOD FOR ADJUSTING CHARACTERISTICS OF A DIELECTRIC FILTER

(75) Inventors: Takahiro Okada, Nomi-gun (JP); Jinsei Ishihara, Kanazawa (JP); Hideyuki Kato, Ishikawa-gun (JP)

(73) Assignee: Murata Manufacturing Co. Ltd, Kyoto-fu (JP)

( * ) Notice: Subject to any disclaimer, the term of this patent is extended or adjusted under 35 U.S.C. 154(b) by 0 days.

(21) Appl. No.: 09/915,117

(22) Filed: Jul. 25, 2001

(65) Prior Publication Data

US 2002/0050875 A1 May 2, 2002

(30) Foreign Application Priority Data

Aug. 10, 2000 (JP) ..... 2000-243302

(51) Int. Cl.[7] ..... H01P 1/205

(52) U.S. Cl. ..... 333/202; 333/207

(58) Field of Search ..... 333/202, 205, 333/206, 207, 235, 17.1

(56) References Cited

FOREIGN PATENT DOCUMENTS

| | | |
|---|---|---|
| JP | 4236505 | 8/1992 |
| JP | 4236506 | 8/1992 |
| JP | 6045802 | 2/1994 |

*Primary Examiner*—Seungsook Ham
(74) *Attorney, Agent, or Firm*—Dickstein, Shapiro, Morin & Oshinsky, LLP.

(57) ABSTRACT

The reflection loss characteristic of a dielectric filter provided with a plurality of stages of resonators is measured, pole frequencies and a balance of heights of peaks in the reflection loss characteristic are sought, and, based on the pole frequencies and the balance of peaks, the part of the filter to be adjusted and the degree of adjustment are determined with reference to a database constructed in advance.

8 Claims, 5 Drawing Sheets

METHOD FOR ADJUSTING CHARACTERISTICS OF A DIELECTRIC FILTER

BACKGROUND OF THE INVENTION

1. Field of the Invention

The present invention relates to a method for adjusting characteristics of a dielectric filter the characteristics of which change by adjusting the dimension, etc., of a fixed adjusting part of the dielectric filter.

2. Description of the Related Art

Up to now, in order to adjust characteristics of a dielectric filter in which fixed electrode films are formed in a dielectric block, when the adjustment is manually carried out by an operator, the adjustment is made by the method of trial and error, and after having gained the knowledge of adjustment an operator in charge is trained. This has resulted in both an increase in the time of adjustment and a lowering of the yield. Then, in order to cope with these problems, applications such as Japanese Unexamined Patent Application Publication No. 4-236505, Japanese Unexamined Patent Application Publication No. 4-236506, and Japanese Unexamined Patent Application Publication No. 6-45802 have been made.

In Japanese Unexamined Patent Application Publication No. 4-236505, based on the envelope of peaks in the reflection loss characteristic of a filter, an adjusting part is determined by theoretical reasoning; in Japanese Unexamined Patent Application Publication No. 4-236506, based on a figure obtained by connecting the peaks and valleys in a reflection loss characteristic, an evaluation function is sought; and in Japanese Unexamined Patent Application Publication No. 6-45802, the error between a reflection loss characteristic and the theoretical value is sought at sampling points of the frequency axis of the reflection loss characteristic which is equally divided, adjustments are carried out in stages, and the adjustment is finished when the evaluation function becomes smaller.

However, in the methods shown in Japanese Unexamined Patent Application Publication No. 4-236505, Japanese Unexamined Patent Application Publication No. 4-236506, and Japanese Unexamined Patent Application Publication No. 6-45802, it is not clearly understood whether or not the value of an adjusting device (for example, resonant frequency of a resonator in a certain stage) is out of its target value, and accordingly there is a problem that the adjustment cannot be necessarily accurately made.

SUMMARY OF THE INVENTION

It is an object of the present invention to provide a method for adjusting characteristics of a dielectric filter in which the experience and skill of adjustment and visual knowledge are not required in actual adjustments, an adjustment by the method of trial and error is reduced, and an automatic adjustment is surely made.

In the present invention, a method for adjusting characteristics of a dielectric filter comprises the steps of measuring characteristics of a dielectric filter provided with a plurality of stages of resonators; and seeking pole frequencies and a balance of heights of peaks in at least a reflection loss characteristic out of the characteristics and, based on the pole frequencies and the balance of height of peaks, determining an adjusting part and a degree of adjustment with reference to a database.

Furthermore, in the method for adjusting characteristics of a dielectric filter, the steps further comprises measuring the center frequency of passband of the dielectric filter, seeking the difference between the center frequency and its target frequency, and, based on the difference, determining an adjusting par and a degree of adjustment with reference to the database.

Thus, the relationship of pole frequencies and a balance of height of peaks in a reflection loss characteristic to an adjusting part and a degree of adjustment is constructed as a database in advance, and then the reflection loss characteristic of a practical dielectric filter for adjustment is measured and, based on the pole frequencies and the balance of heights of the peaks, the adjusting part and the degree of adjustment are surely determined with reference to the database.

The pole frequencies in the above reflection loss characteristic do not represent the frequencies of discrete resonators, but the frequencies in coupled modes when the resonators are coupled to each other, and accordingly the pole frequencies are intuitively and visually easy to understand and give theoretical clear indexes for adjustment. The above database is constructed in such a way that the data showing the relationship of pole frequencies and balances of height of peaks in reflection loss characteristics to various patterns of dispersion of adjusting devices (resonant devices and coupling devices as objects for adjustment when the adjusting devices are represented by their equivalent circuits) are obtained by making use of the knowledge of skilled workers for adjustment and theoretical analyses or by using a simulator and thus the database is constructed.

Furthermore, in addition to the above reflection loss characteristic, as the difference between the center frequency of passband and its target frequency is also connected with the difference between resonant frequencies of the resonant devices, taking also the center frequencies of passband into consideration makes an adjusting part and a degree of adjustment more surely determined.

BRIEF DESCRIPTION OF THE DRAWINGS

Other features and advantages of the present invention will become apparent from the following description of the invention which refers to the accompanying drawings.

DETAILED DESCRIPTION OF EMBODIMENTS OF THE INVENTION

A method for adjusting characteristics of a dielectric filter according to an embodiment of the present invention is described with reference to each of the drawings.

Figure 1:
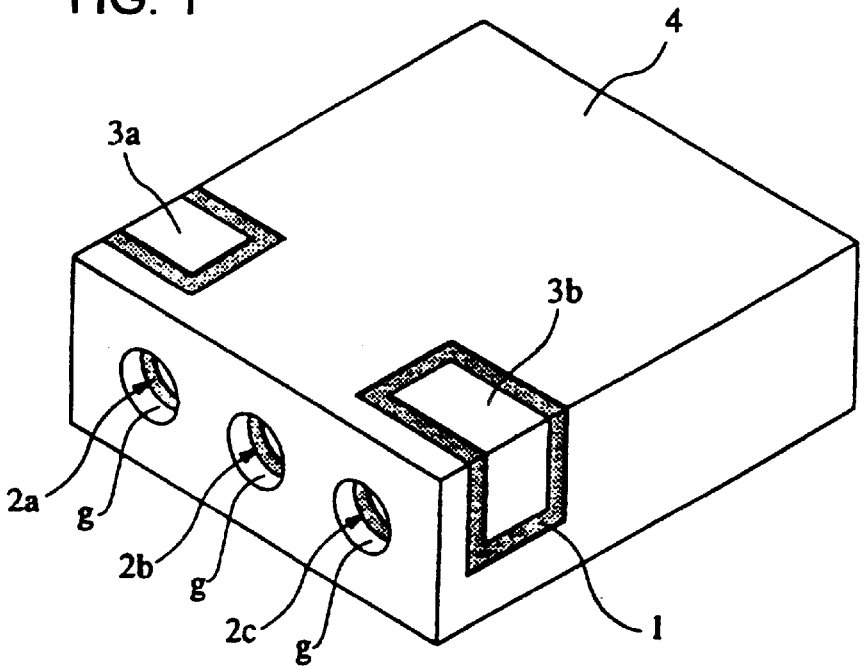
FIG. 1 is a perspective view of a dielectric filter according to an embodiment of the present invention.

FIG. 1 is a perspective view of a dielectric filter. In FIG. 1, a dielectric block 1 as a whole is substantially in the shape of a rectangular solid, and, inside the dielectric block 1, internal-conductor-formed holes 2*a*, 2*b*, and 2*c* on the inner surface of which an internal conductor is formed, are provided. On the outside surface (six sides) of the dielectric block 1, an external conductor 4 is formed. Furthermore, on the outside surface of the dielectric block 1, input-output electrodes 3*a* and 3*b*, which are separated from the external conductor 4, are formed. In the vicinity of one opening surface of the internal-conductor-formed holes 2*a*, 2*b*, and 2*c*, no internal-conductor-formed area g, in which the internal conductor is removed, is provided along the periphery of the hole. This part functions as an open end of the internal conductor, which is a resonant line, and the neighboring resonators are inductively coupled to each other by a tip capacitance generated between each of the open ends and the external conductor 4. Furthermore, capacitances are produced between the input-output electrodes 3*a* and 3*b* and the vicinity of the open ends of the internal-conductor-formed holes 2*a* and 2*c*, respectively, and these capacitances function as coupling capacitances for inputting and outputting.

A dielectric filter having bandpass characteristics is composed of three stages of one-fourth wavelength resonators, which has the construction shown in FIG. 1.

The characteristics of the above dielectric filter is determined by the dielectric constant of the dielectric block 1, the dimension of each part of the dielectric block 1, and the dimension of the conductors and electrodes formed in the dielectric block 1. In particular, the resonant frequencies of the resonators are decided by the location and gap of the not internal-conductor-formed areas g provided on the inner surface of the internal-conductor-formed holes, and the degree of coupling between the resonators is decided by the gap of the not internal-conductor-formed areas. Furthermore, the external Q's (Qe) are decided by the location where the input-output electrodes 3*a* and 3*b* are formed and by the dimension of the input-output electrodes 3*a* and 3*b*.

Therefore, in order to obtain fixed characteristics, the material of the dielectric block 1 is selected, and the dimension of each part of the dielectric block 1, the location and dimension of the not internal-conductor-formed areas g, the location and dimension of the input-output electrodes 3*a* and 3*b*, etc., are designed in advance. However, practically because of variations in the dielectric constant of the dielectric block 1, the dimension of each part of the dielectric block 1, and the dimension of the not internal-conductor-formed areas g and the input-output electrodes 3*a* and 3*b* is inevitable, adjustments for obtaining fixed filtering characteristics become indispensable.

Figure 2:
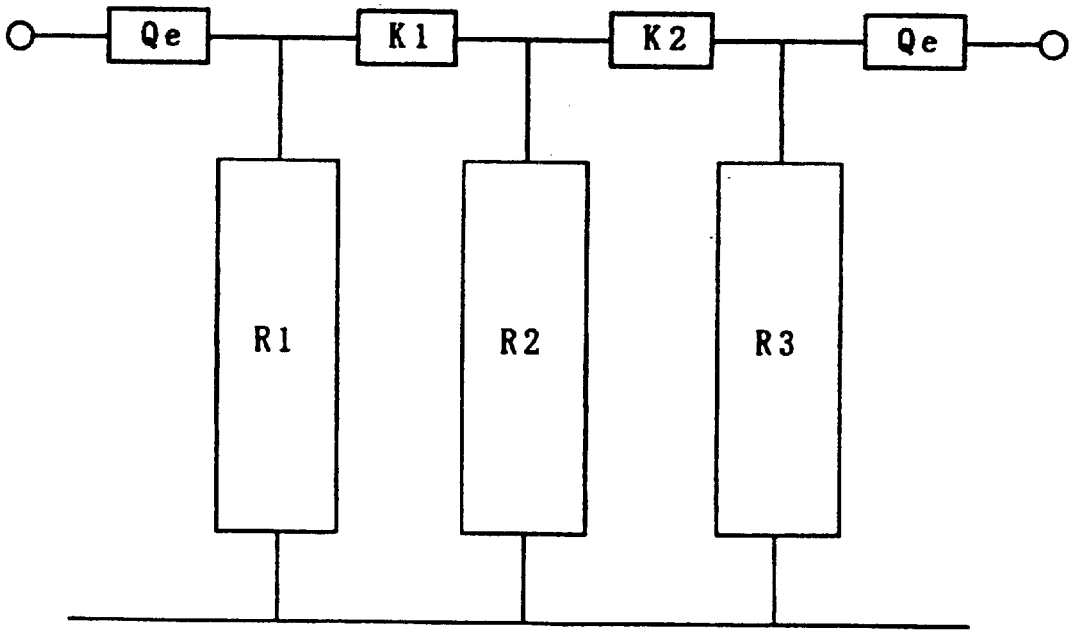
FIG. 2 is an equivalent circuit diagram of the dielectric filter of FIG. 1.

FIG. 2 is an equivalent circuit diagram of the above dielectric filter. Here, the resonators R1, R2, and R3 are composed of the internal conductors on the inner surface of the internal-conductor-formed holes 2*a*, 2*b*, and 2*c* shown in FIG. 1 and the dielectric material and external conductor 4 of the dielectric block 1. The coupling impedances between the neighboring resonators are shown by K1 and K2, and the external coupling Q's between the resonator R1 of the first stage and the input-output electrode and between the resonator R3 of the third stage and the input-output electrode are shown by Qe.

Figure 3:
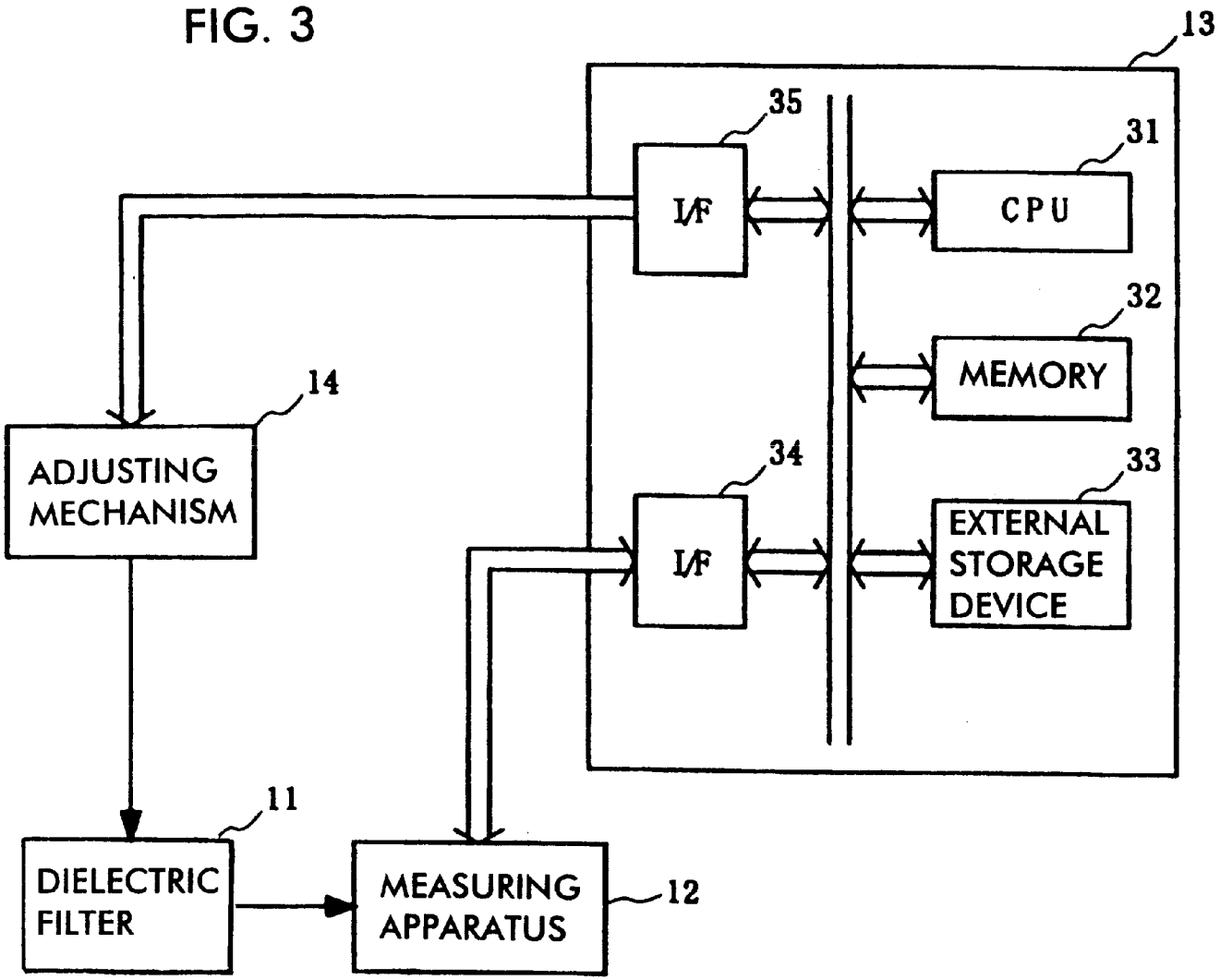
FIG. 3 is a block diagram showing the construction of an apparatus for adjusting characteristics of the dielectric filter according to an embodiment of the present invention.

FIG. 3 is a block diagram showing the construction of an apparatus for adjusting characteristics of the above dielectric filter. Here, a dielectric filter 11 is the object for adjustment. A measuring apparatus 12 made up of a network analyzer, etc., measures the pass characteristics and reflection characteristic of the dielectric filter 11. Based on the data measured by the measuring apparatus 12, a data processor 13 ultimately gives control data to an adjusting mechanism 14. The adjusting mechanism 14 made up of a cutting machine makes adjustments to the location and gap of the not internal-conductor-formed areas g of the dielectric filter 11 shown in FIG. 1.

The above data processor 13 is composed of a CPU 31, a memory 32, an external storage device 33, an interface circuit 34 to the measuring apparatus 12, an interface circuit 35 to the adjusting mechanism 14, etc.

Figure 4:
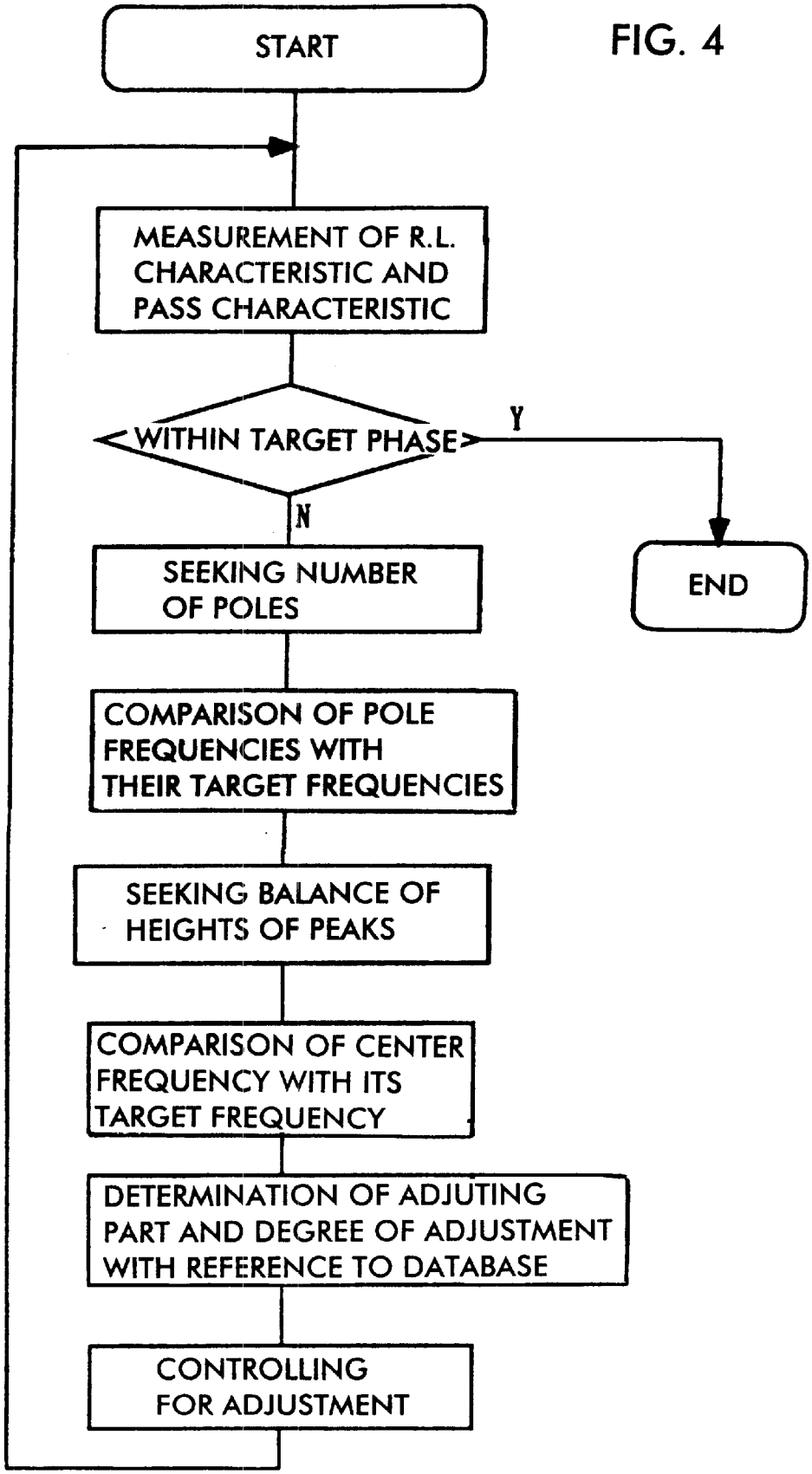
FIG. 4 is a flow chart showing the procedures of processing in a data processor of the apparatus of FIG. 3.

FIG. 4 is a flow chart showing the procedures of processing in the above data processor 13. First of all, the reflection loss characteristic and pass characteristic of the dielectric filter 11 are measured by using the measuring apparatus 12, and the frequencies of poles and the number of poles in the reflection loss characteristic are determined.

Figure 5A:
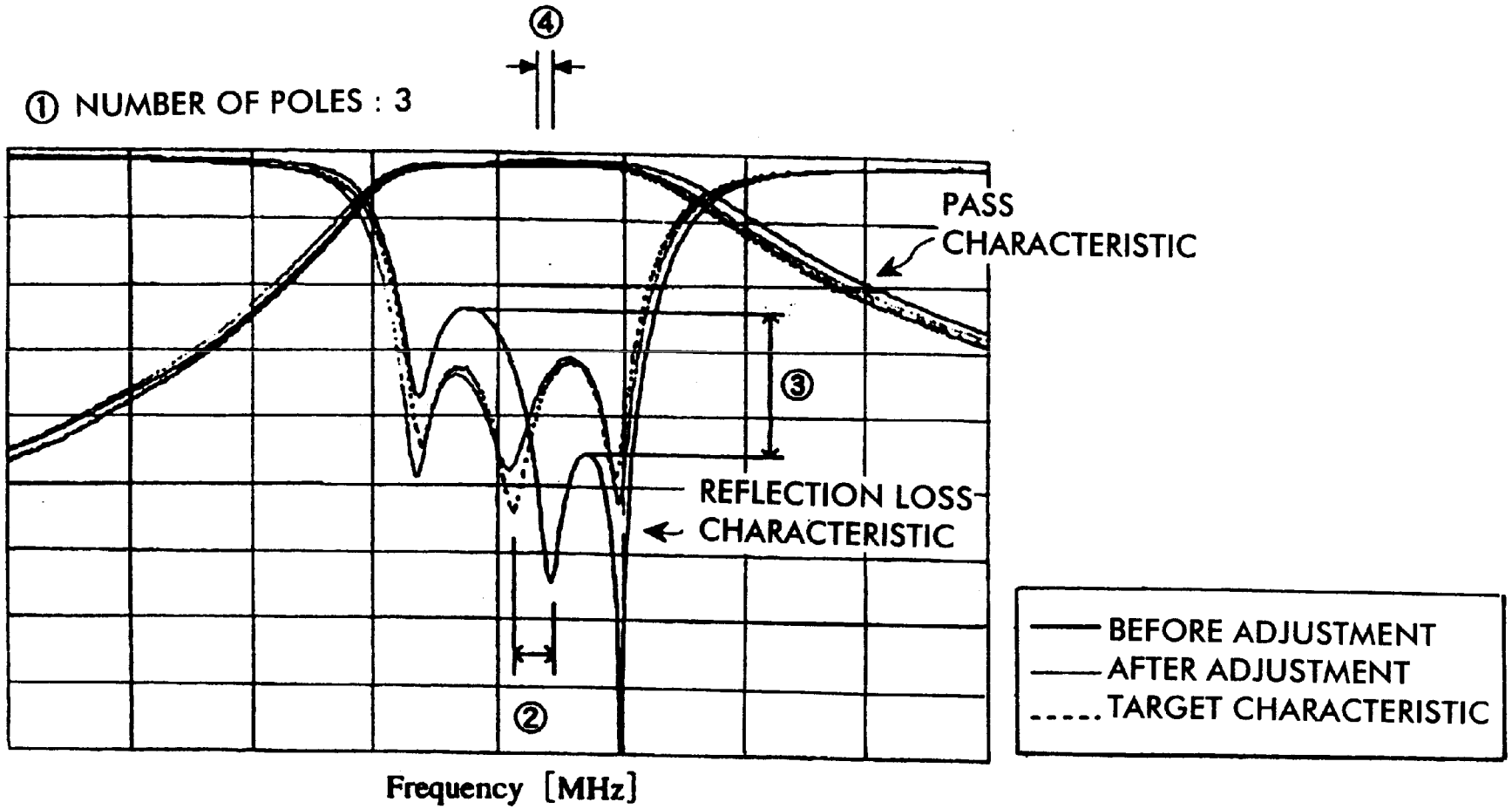
FIGS. 5A and 5B show two examples of the characteristics of the dielectric filter.
Figure 5B:
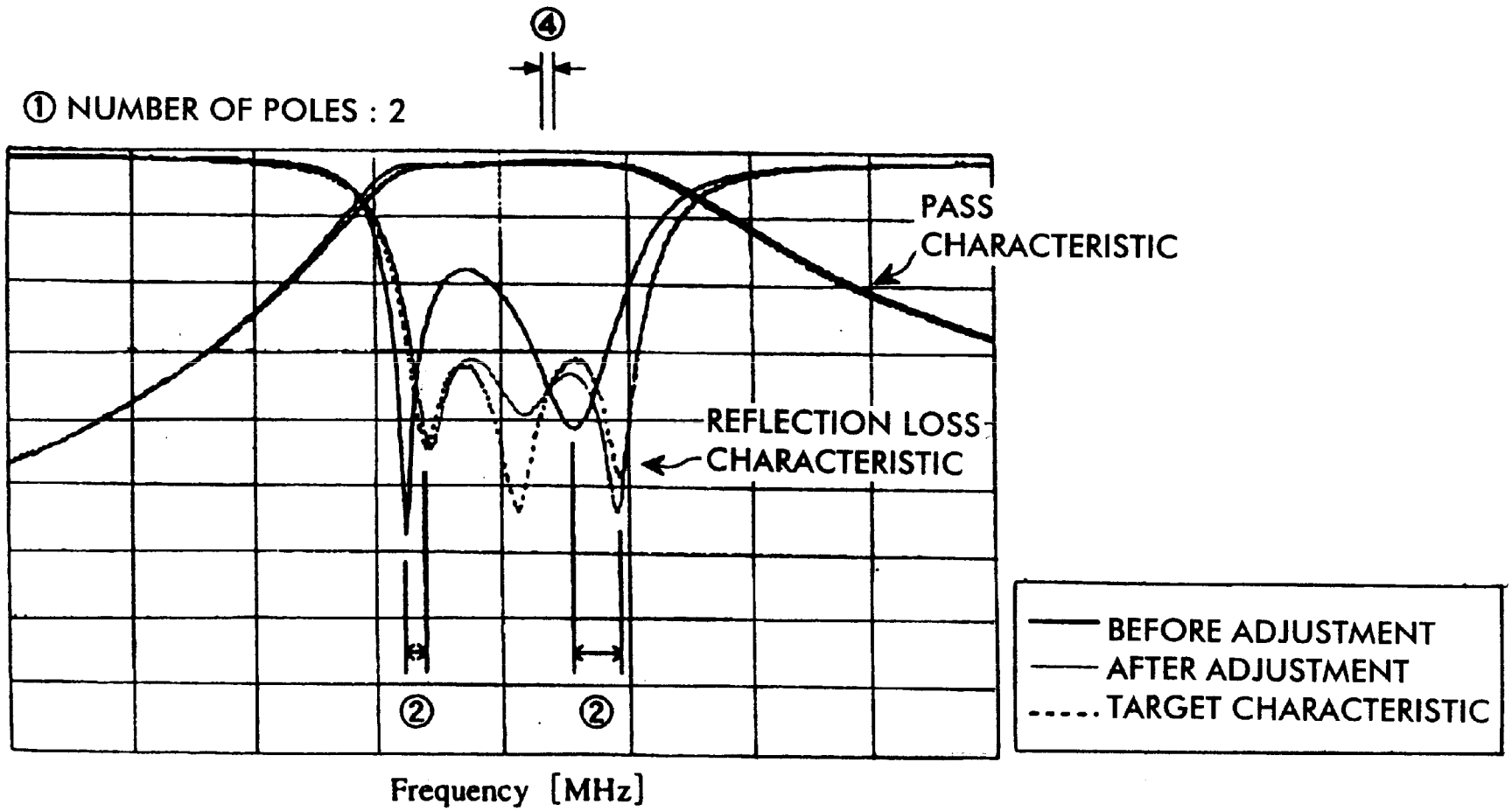

In FIGS. 5A and 5B, two examples of the characteristics of dielectric filters are shown.

In the example of FIG. 5A, 1) the number of poles is three,
2) the frequencies of the poles are higher than the target frequency,
3) the peaks in the reflection loss characteristic are out of balance, and
4) the center frequency is higher than the target frequency.

Also in FIG. 5B, 1) the number of poles is two,
2) there is a difference in the pole frequencies,
3) there is one peak in the reflection loss characteristic, and
4) the center frequency is substantially the same as the target frequency.

The above pole frequencies are found in such a way that the slope of change of the reflection loss in a fixed small frequency difference is determined in a fixed frequency band, and the frequency at which the slope becomes the minimum is sought. In the reflection loss characteristic, the part which sharply changes downward represents a pole and, in the example shown in FIG. 5A, there are three poles before adjustment. In the example shown in FIG. 5B, there are only two poles before adjustment.

Next, the difference between the above pole frequencies and their target frequencies is sought, respectively. In the example shown in FIG. 5A, the pole frequency of the middle of the three poles is shifted from the corresponding pole frequency in the target characteristic to the higher frequency side by a frequency band shown by (2).

In succession, the balance of heights of the peaks in the reflection loss characteristic (difference between the heights of the peaks in the reflection loss characteristic) is sought. In the example of FIG. 5A, the heights of the two peaks are different by the extent shown by (3). Furthermore, in the example shown in FIG. 5B, because there are only two poles, i.e., only one peak, no difference between two peaks is determined.

Further, the difference between the center frequency of the passband and its target frequency is sought. In the example shown in FIG. 5A, the center frequency is higher than the target frequency by a frequency band shown by (4).

In succession, based on the data shown by above (1) to (4), an adjusting part and a degree of adjustment are determined with reference to the database. In the dielectric filter showing the characteristic shown in FIG. 5A, the frequencies of the resonators R1 and R3 are high, and with reference to the above-mentioned database, the adjusting parts in the internal-conductor-formed holes 2*a* and 2*c* shown in FIG. 1 and the degree of the adjustment can be decided.

Furthermore, in the dielectric filter showing the characteristic shown in FIG. 5B, the frequencies of the resonators R1 and R3 are high and the frequency of R2 is low, and accordingly, with reference to the above database, the adjusting parts in the internal-conductor-formed holes 2*a*, 2*b*, and 2*c* and the degree of the adjustment are decided in order to reduce the resonant frequencies of R1 and R3 and to increase the resonant frequency of R2.

After that, the appropriate adjusting part is adjusted by a determined degree of adjustment by controlling the adjusting mechanism 14 shown in FIG. 3.

Next, when the reflection loss characteristic and pass characteristic of the dielectric filter are measured again and the characteristic values are within the target range, it is considered that the adjustment has been completed and the adjustment process ends. If the characteristic values are not within the target range at this stage, then the number of poles in the reflection loss characteristic is sought, the comparison of the pole frequencies with their target frequencies is made, the balance of heights of the peaks in the reflection loss characteristic is sought, and the comparison of the center frequency with its target frequency is made, and thus the adjusting part and the degree of adjustment are determined and the adjustment is made accordingly.

When the degree of adjustment at a time is set to be slightly less than the degree of adjustment determined based on the above database by a fixed ratio, the above-mentioned measurement of characteristics and adjustment may be repeated a couple of times; thus, wrong adjustments can be avoided due to excessive adjustment.

Moreover, in the examples shown in the above, in a dielectric filter using a dielectric block, the adjustment of characteristics is made by trimming no internal-conductor-formed areas in the internal-conductor-formed holes, but the dimension in a fixed direction of the input-output electrodes may be adjusted.

Furthermore, the adjustment of characteristics may be made not only by adjusting the dimension of the electrodes, but also, for example, by cutting the dielectric body in a fixed part on the side of the open end of the dielectric block or by partially cutting the external conductor on the side of the short-circuited end of the dielectric block.

Moreover, in the examples described in the above, the adjustment of characteristics is accomplished by using a cutting machine such as a router (grinding wheel), etc., but the adjustment of characteristics may be carried out by trimming the electrodes and a part of the dielectric body of the dielectric filter using a laser trimming apparatus.

According to the present invention, based on the practical characteristic values of a dielectric filter before adjustment, an adjusting part and a degree of adjustment can be accurately determined in order to make the filtering characteristics of the dielectric filter close to the designed values, and thus fixed filtering characteristics can be easily and surely obtained.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for adjusting the characteristics of a dielectric filter, the method comprising:

measuring characteristics of a dielectric filter provided with a plurality of stages of resonators;

determining pole frequencies and a balance of heights of peaks in a reflection loss characteristics out of the measured characteristics of the dielectric filter; and adjusting at least one physical part of the dielectric filter based on the pole frequencies and the balance of heights of peaks in the reflection loss characteristics.

2. The method for adjusting the characteristics of a dielectric filter as claimed in claim 1, further comprising:

measuring a center frequency of passband of the dielectric filter;

determining the difference between the center frequency and a target frequency of the dielectric filter; and adjusting the at least one physical part of the dielectric filter based on the difference.

3. The method for adjusting the characteristics of a dielectric filter as claimed in claims 1 and 2, wherein the adjusting includes determining a degree of adjustment by reference to a database.

4. The method for adjusting the characteristics of a dielectric filter as claimed in claims 1 and 2, wherein the at least one physical part adjusted is determined by reference to a database.

5. The method for adjusting the characteristics of a dielectric filter as claimed in claim 3, wherein the at least one physical adjusted is determined by reference to the database.

6. The method for adjusting the characteristics of a dielectric filter as claimed in claims 1 and 2, wherein the adjusting is repeatedly performed until the characteristics of the dielectric filter are within a target range.

7. The method for adjusting the characteristics of a dielectric filter as claimed in claim 5, wherein the adjusting is repeatedly performed until the characteristics of the dielectric filter are within a target range.

8. The method for adjusting the characteristics of a dielectric filter as claimed in claim 1, wherein the at least one physical part of the dielectric filter is one or more of the resonators in the plurality of stages of resonators, one or more input-output electrodes, a body of the dielectric filter and an external conductor.

* * * * *